US009146568B2

(12) United States Patent
Takahashi et al.

(10) Patent No.: US 9,146,568 B2
(45) Date of Patent: Sep. 29, 2015

(54) POWER SUPPLY VOLTAGE REGULATING APPARATUS, INTEGRATED CIRCUIT, AND ELECTRONIC APPARATUS

(71) Applicant: Panasonic Corporation, Osaka (JP)

(72) Inventors: Kouji Takahashi, Shiga (JP); Makoto Ohba, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 0 days.

(21) Appl. No.: 14/609,411

(22) Filed: Jan. 29, 2015

(65) Prior Publication Data

US 2015/0234400 A1 Aug. 20, 2015

(30) Foreign Application Priority Data

Feb. 19, 2014 (JP) ..... 2014-029645

(51) Int. Cl.
*G05F 1/575* (2006.01)
*G05F 1/46* (2006.01)

(52) U.S. Cl.
CPC ..... *G05F 1/461* (2013.01); *G05F 1/463* (2013.01)

(58) Field of Classification Search
CPC ..... G05F 1/461; G05F 1/463
USPC ..... 323/273–281
See application file for complete search history.

(56) References Cited

U.S. PATENT DOCUMENTS

| | | | | |
|---|---|---|---|---|
| 6,411,531 | B1 * | 6/2002 | Nork et al. | 363/60 |
| 6,522,111 | B2 * | 2/2003 | Zadeh et al. | 323/277 |
| 2006/0012354 | A1 * | 1/2006 | Nunokawa et al. | 323/273 |
| 2011/0227553 | A1 * | 9/2011 | Joo | 323/311 |

FOREIGN PATENT DOCUMENTS

JP 62-225006 10/1987

* cited by examiner

*Primary Examiner* — Jue Zhang
(74) *Attorney, Agent, or Firm* — Greenblum & Bernstein, P.L.C.

(57) ABSTRACT

A power supply voltage regulating apparatus includes: a reference voltage generating circuit that generates a reference voltage; an operational amplifier that amplifies the reference voltage and outputs the amplified reference voltage as a power supply voltage; a switching circuit that is connected between an output terminal of the operational amplifier and ground, and that performs a switching operation; a ring oscillator that is connected in parallel with the switching circuit between the output terminal of the operational amplifier and ground, and that generates an oscillation signal; and a controller that is connected with an input terminal of the reference voltage generating circuit, and that controls the reference voltage in accordance with an oscillating frequency of the oscillation signal, a temperature of the switching circuit, and an operating frequency of the switching circuit, to regulate the power supply voltage that is output from the operational amplifier.

16 Claims, 11 Drawing Sheets

POWER SUPPLY VOLTAGE REGULATING APPARATUS, INTEGRATED CIRCUIT, AND ELECTRONIC APPARATUS

CROSS REFERENCES TO RELATED APPLICATIONS

This application claims priority to Japanese Patent Application No. 2014-029645, filed on Feb. 19, 2014, the contents of which are hereby incorporated by reference.

BACKGROUND

1. Technical Field

The present disclosure relates to a power supply voltage regulating apparatus for an electronic apparatus.

2. Description of the Related Art

An arrangement in which a variable resistor is connected to a power supply side and a GND (ground) side of a switching circuit has been proposed (see, for example, Japanese Unexamined Patent Application Publication No. 62-225006) as a conventional art for reducing power consumption of a switching circuit (a circuit handling an alternating-current signal). For example, FIG. 1 illustrates an example of a configuration of a power supply voltage regulating apparatus that supplies a power supply voltage to a switching circuit according to the conventional art. According to this arrangement, a signal amplitude of the switching circuit is detected, and resistance values of the variable resistors (R1 and R2) are controlled in accordance with the result of the detection. That is, the resistance values of the variable resistors are increased within a range in which the switching circuit can operate. Thus, the variable resistors function as current-limiting resistors of the switching circuit. In this way, a reduction in power consumption of the switching circuit is achieved.

SUMMARY

However, according to the above conventional art, a voltage fluctuation occurs at connection nodes between the variable resistors and the switching circuit due to an electric current variation caused by switching. This undesirably causes a deterioration in the phase noise (jitter) characteristics of a switching signal.

One non-restricting and exemplary embodiment provides a power supply voltage regulating apparatus that can achieve a reduction in power consumption of a switching circuit while suppressing occurrence of phase noise.

Additional benefits and advantages of the disclosed embodiments will be apparent from the specification and Figures. The benefits and/or advantages may be individually provided by the various embodiments and features of the specification and drawings disclosure, and need not all be provided in order to obtain one or more of the same.

In one general aspect, the techniques disclosed here feature a power supply voltage regulating apparatus including: a reference voltage generating circuit that generates a reference voltage; an operational amplifier that amplifies the reference voltage and outputs the amplified reference voltage as a power supply voltage; a switching circuit that is connected between an output terminal of the operational amplifier and ground, and that performs a switching operation; a ring oscillator that is connected in parallel with the switching circuit between the output terminal of the operational amplifier and the ground, and that generates an oscillation signal; and a controller that is connected with an input terminal of the reference voltage generating circuit, and that controls the reference voltage in accordance with an oscillating frequency of the oscillation signal, a temperature of the switching circuit, and an operating frequency of the switching circuit, to regulate the power supply voltage that is output from the operational amplifier.

These general and specific aspects may be implemented using a system, a method, and a computer program, and any combination of systems, methods, and computer programs.

According to the present disclosure, it is possible to achieve a reduction in power consumption of a switching circuit while suppressing occurrence of phase noise.

DETAILED DESCRIPTION

Figure 1:
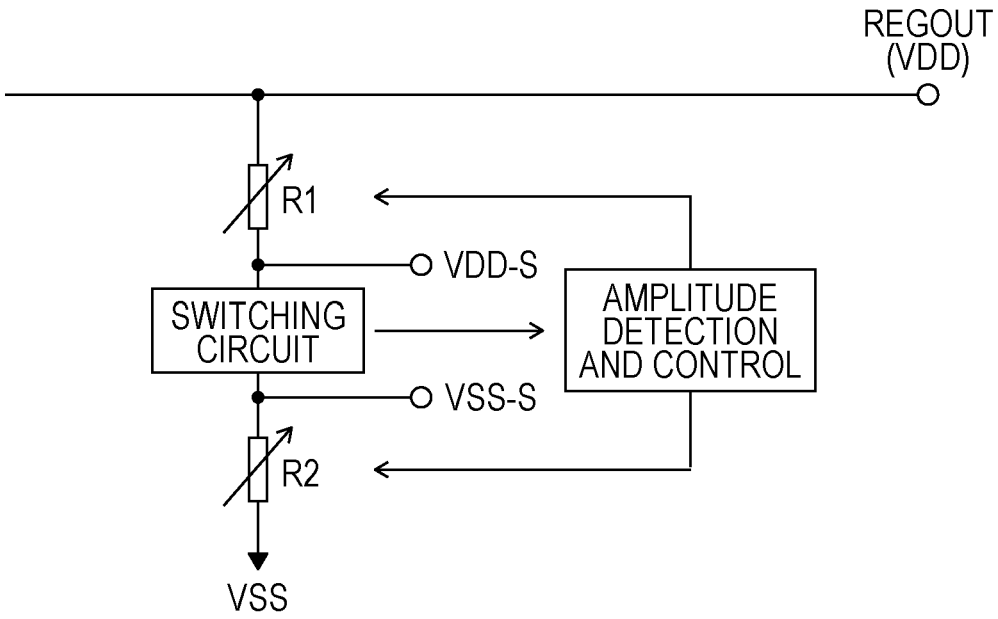
FIG. 1 PRIOR ART
FIG. 1 is a view illustrating an example of a configuration of a conventional power supply voltage regulating apparatus.

Embodiments of the present disclosure are described below in detail with reference to the drawings. Note, however, that in the embodiment, identical constituent elements are given identical reference numerals, and are not explained repeatedly.

Embodiment 1

Figure 2:
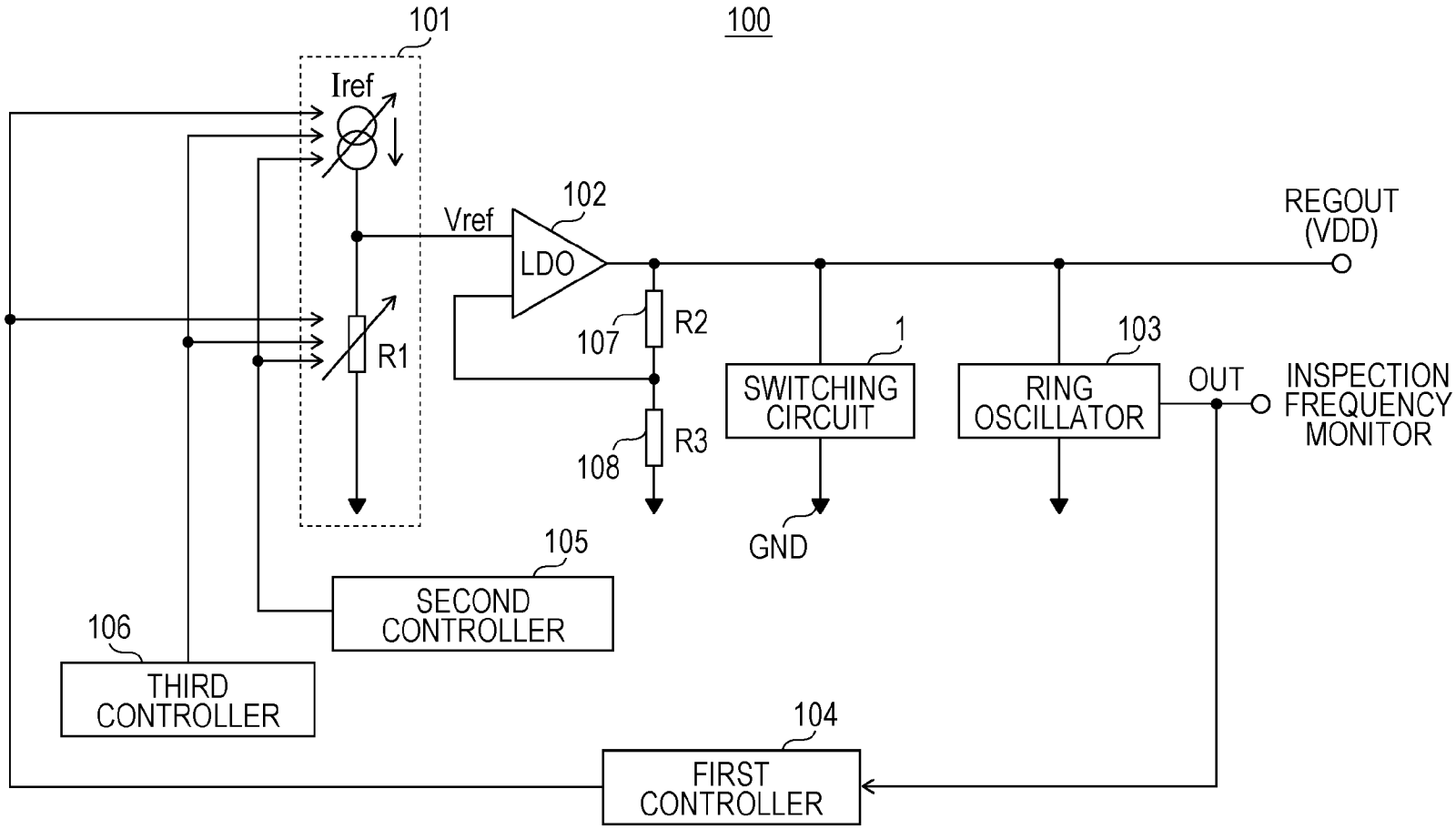
FIG. 2 is a view illustrating a configuration of a power supply voltage regulating apparatus and a configuration of a switching circuit according to Embodiment 1.

FIG. 2 is a view illustrating a configuration of a power supply voltage regulating apparatus and a configuration of a switching circuit according to the present embodiment. A power supply voltage regulating apparatus 100 illustrated in FIG. 2 regulates a power supply voltage (REGOUT (VDD) to be supplied to a switching circuit 1.

Configuration of Switching Circuit

The switching circuit 1 performs a switching operation. The switching circuit 1 is a circuit that handles an alternating-current signal and is a switching circuit having no constant electric current. As illustrated in FIG. 2, the switching circuit 1 is connected between an output terminal (REGOUT (VDD)) of an LDO (Low Drop Out) 102, which is an operational amplifier, and GND.

Examples of the switching circuit 1 encompass an inverter multi-stage connection circuit (FIG. 3), a crystal-oscillator circuit (FIG. 4), a voltage controlled oscillator (VCO) circuit (FIG. 5), a flip-flop circuit (not illustrated), and a NAND circuit (not illustrated). These switching circuits are constituted by an element such as a metal oxide semiconductor (MOS) transistor.

The following describes configurations of an inverter multi-stage connection circuit, a crystal-oscillator circuit, and a VCO circuit. Note that REGOUT (VDD) and VSS illustrated in FIGS. 3 to 5 correspond to REGOUT (VDD) and GND (VSS) illustrated in FIG. 2, respectively.

Figure 3:
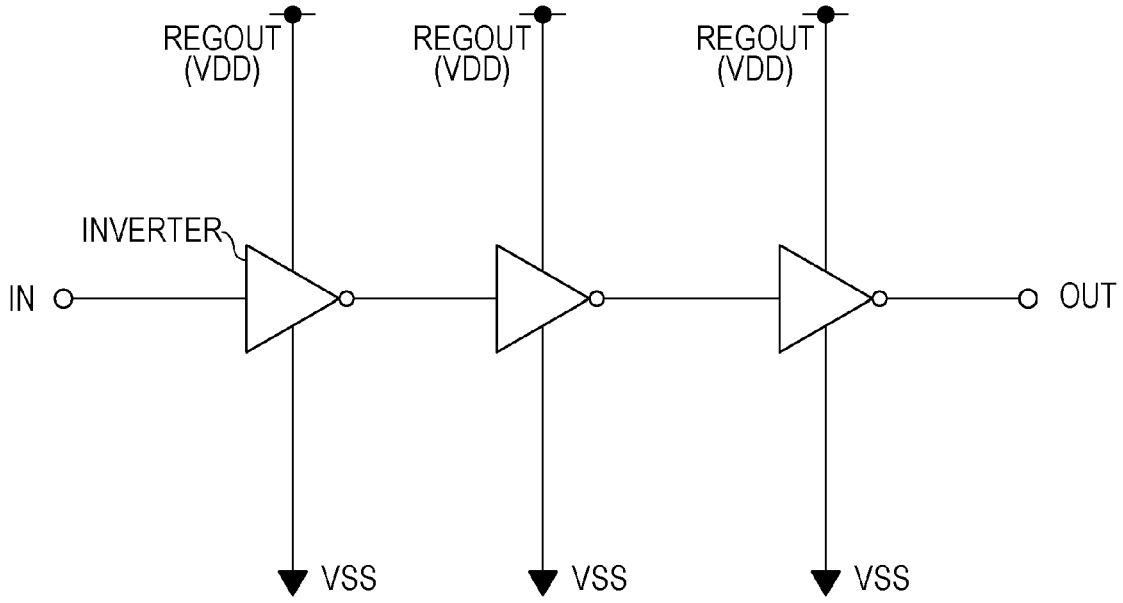
FIG. 3 is a view illustrating an example of a configuration (inverter multi-stage connection circuit) of the switching circuit.

For example, FIG. 3 illustrates an example of a configuration of an inverter multi-stage connection circuit. In the inverter multi-stage connection circuit illustrated in FIG. 3, inverters serially connected between an input and an output (IN and OUT). Note that each of the inverters is, for example, constituted by a PchMOS transistor and a NchMOS transistor (not illustrated).

Figure 4:
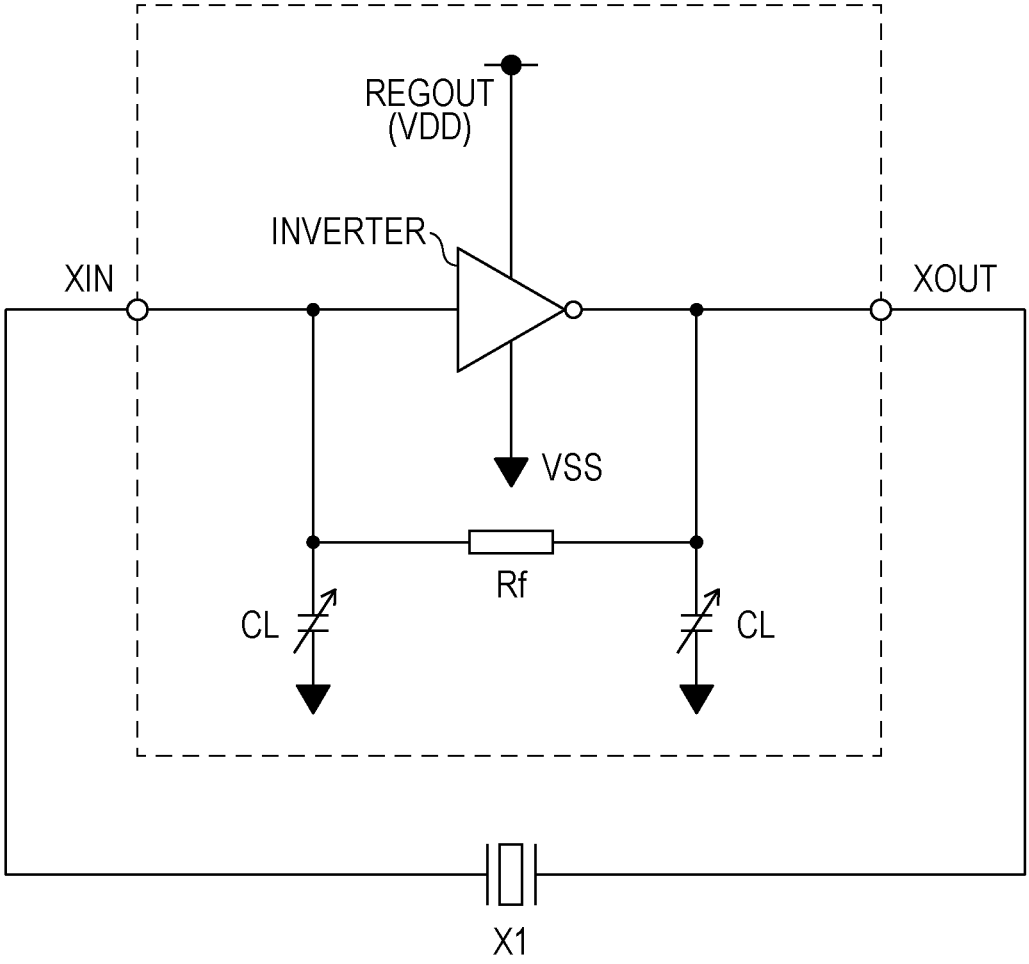
FIG. 4 is a view illustrating an example of a configuration (crystal-oscillator circuit) of the switching circuit.

FIG. 4 illustrates an example of a configuration of a crystal-oscillator circuit. In the crystal-oscillator circuit illustrated in FIG. 4, a resistor Rf that feeds an output of an inverter back to an input side is connected between the input and the output of the inverter. Furthermore, a crystal X1 and a load capacitor CL are connected to both the input side and the output side of the inverter. As in FIG. 3, the inverter is, for example, constituted by an MOS transistor. In general, the configuration surrounded by the broken line in FIG. 4 is realized by an integrated circuit.

Figure 5:
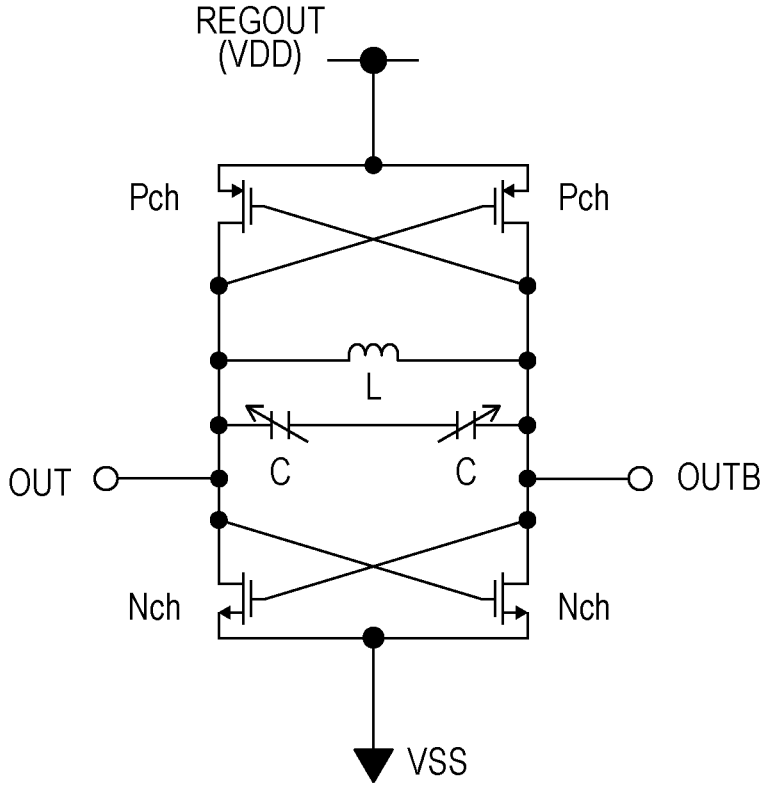
FIG. 5 is a view illustrating an example of a configuration (VCO circuit) of the switching circuit.

In the example illustrated in FIG. 5, a VOC circuit is made up of two NchMOS transistors, two PchMOS transistors, an inductor L, and two varactor diodes (variable-capacitance diodes) C. In the VCO circuit illustrated in FIG. 5, a source terminal of each of the PchMOS transistors is connected to REGOUT, and a drain terminal of each of the PchMOS transistors is connected to a gate terminal of the other one of the PchMOS transistors and to a drain terminal of the NchMOS transistor. Furthermore, a source terminal of each of the NchMOS transistors is connected to GND (VSS), and a drain terminal of each of the NchMOS transistors is connected to a gate terminal of the other one of the NchMOS transistors and to the drain terminal of the PchMOS transistor. Furthermore, the inductor, the varactor diodes, and output terminals (OUT and OUTB) are connected to a drain terminal of each of the MOS transistors. The VCO circuit oscillates at a frequency of $1/(2\pi\sqrt{(LC)})$.

Note that the configuration of the switching circuit 1 is not limited to the above configuration example.

Configuration of Power Supply Voltage Regulating Apparatus

The power supply voltage regulating apparatus 100 illustrated in FIG. 2 includes a reference voltage generating circuit 101, an LDO (Low Drop Out) 102, which is an operational amplifier, a ring oscillator 103, a first controller 104, a second controller 105, a third controller 106, and output resistors 107 and 108 (hereinafter also referred to as output resistors R2 and R3).

The reference voltage generating circuit 101 generates a reference voltage Vref. Specifically, the reference voltage generating circuit 101 causes a variable constant electric current Iref to flow into a variable resistor R1 and supplies a reference voltage Vref obtained by current-voltage conversion to one input terminal of the LDO 102. Note that, in the reference voltage generating circuit 101, values of the variable constant electric current circuit Iref and the variable resistor R1 are controlled by the first controller 104, the second controller 105, and the third controller 106 that will be described later. The first controller 104 performs control based on the oscillating frequency of the ring oscillator 103. The second controller 105 performs control based on the temperature characteristics of the switching circuit 1. The third controller 106 performs control based on the operating frequency of the switching circuit. Furthermore, the variable constant electric current circuit Iref includes a constant electric current circuit which causes the variable constant electric current Iref to monotonically increase in accordance with temperature. The gradient of the monotonic increase of the variable constant electric current Iref with respect to the temperature corresponds to the temperature characteristics of the switching circuit 1.

The reference voltage Vref is input to one input terminal of the LDO 102, and a feedback voltage from a midpoint between the output resistors R3 and R2 is input to the other input terminal of the LDO 102. Accordingly, a voltage of (Vref/R3)*(R2+R3) is output as a power supply voltage REGOUT (VDD), which is output of the LDO 102. That is, when the reference voltage Vref changes, the power supply voltage REGOUT also changes. In this way, the LDO 102 amplifies the reference voltage Vref to output the power supply voltage REGOUT. Note that a diode may be serially connected to part of the variable resistor R1 and part of the output resistors R3. Note also that such an arrangement is also possible in which the output resistor R2 is not provided depending on an output voltage value.

Figure 6:
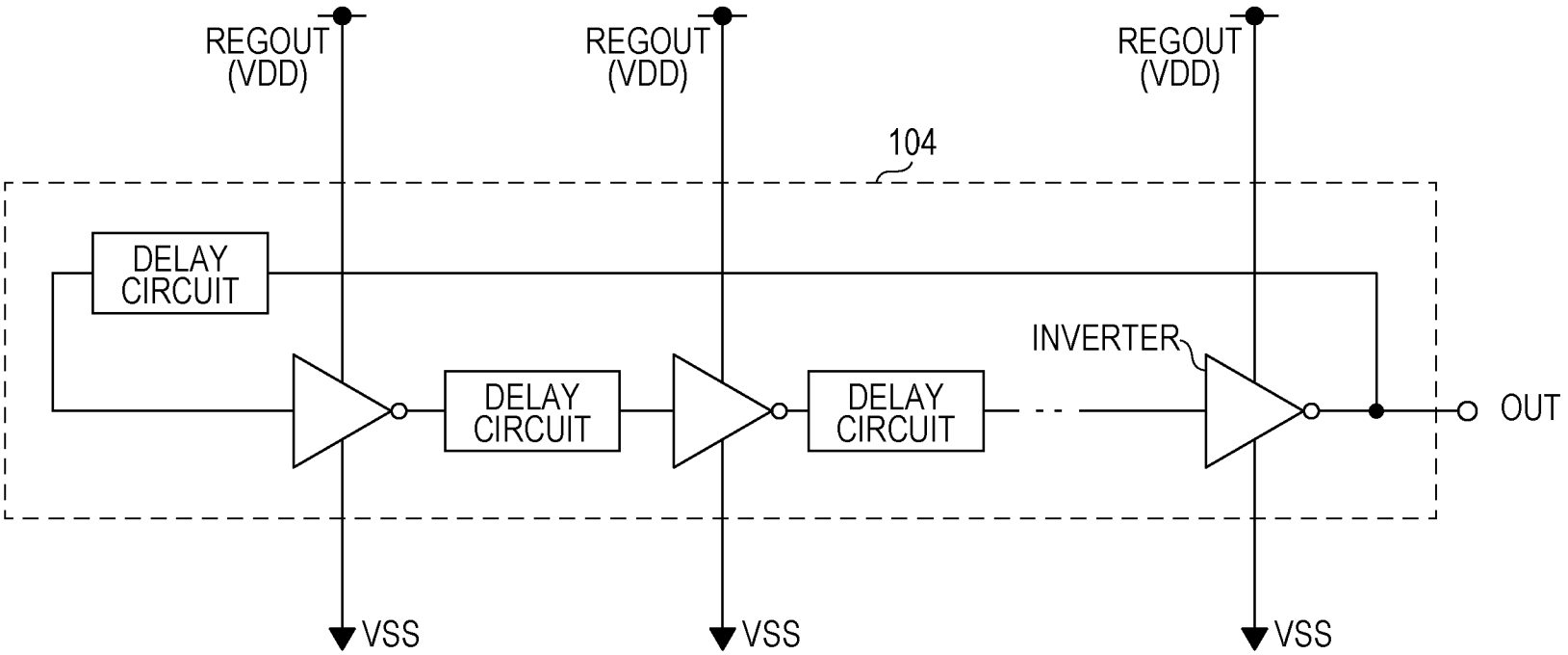
FIG. 6 is a view illustrating an example of a configuration of a ring oscillator.

The ring oscillator 103 is connected in parallel with the switching circuit 1 between the output terminal (REGOUT (VDD)) of the LDO 102 and GND. The ring oscillator 103 generates an oscillation signal and supplies the oscillation signal to the first controller 104. The ring oscillator 103 is constituted by an MOS transistor that has a configuration (size) substantially identical to the MOS transistor constituting the switching circuit 1. For example, FIG. 6 illustrates an example of a configuration of the ring oscillator 103. As illustrated in FIG. 6, the ring oscillator 103 has, for example, a ring-like configuration in which a plurality of inverters and a plurality of delay circuits are alternately connected. For example, each of the inverters illustrated in FIG. 6 is constituted by an MOS transistor that has a configuration substantially identical to the MOS transistor constituting the switching circuit 1.

Note that REGOUT (VDD), VSS, and an output terminal OUT illustrated in FIG. 6 correspond to REGOUT (VDD), VSS, and an output terminal OUT illustrated in FIG. 2, respectively. The configuration of the ring oscillator 103 is not limited to the example of the configuration illustrated in FIG. 6.

The first controller 104 regulates a power supply voltage REGOUT by setting the reference voltage Vref in accordance with the oscillating frequency of the oscillation signal of the ring oscillator 103. Specifically, the first controller 104 controls the variable constant electric current circuit Iref or the variable resistor R1 of the reference voltage generating circuit 101 in accordance with the oscillating frequency of the ring oscillator 103.

The second controller 105 regulates the power supply voltage REGOUT by setting the reference voltage Vref in accordance with the temperature characteristics of the switching circuit 1. Specifically, the second controller 105 controls the variable constant electric current circuit Iref or the variable resistor R1 of the reference voltage generating circuit 101 in accordance with the temperature characteristics of the switching circuit 1.

The third controller 106 regulates the power supply voltage REGOUT by setting the reference voltage Vref in accordance with the operating frequency of the switching circuit 1. Specifically, the third controller 106 controls the variable constant electric current circuit Iref or the variable resistor R1 of the reference voltage generating circuit 101 in accordance with the operating frequency of the switching circuit 1.

As described above, the power supply voltage regulating apparatus 100 regulates the power supply voltage in accordance with the oscillating frequency of the oscillation signal of the ring oscillator 103, the temperature of the switching circuit 1, and the operating frequency of the switching circuit 1. Specifically, the power supply voltage regulating apparatus 100 generates the reference voltage Vref by setting the variable constant electric current circuit Iref or the variable resistor R1 in the reference voltage generating circuit 101 in accordance with the oscillating frequency of the ring oscillator 103, the temperature of the switching circuit 1, and the operating frequency of the switching circuit 1. As this reference voltage Vref becomes higher, the power supply voltage becomes higher.

That is, the power supply voltage regulating apparatus 100 regulates the power supply voltage by controlling the reference voltage Vref.

Since the ring oscillator 103 is used to regulate an initial value of the power supply voltage in the first controller 104, the ring oscillator 103 may be controlled to turn off after the regulation of the power supply voltage by an on/off controller (not illustrated). With this arrangement, the ring oscillator 103 does not consume power after the regulation of the power supply voltage. It is therefore possible to further reduce power consumption.

Furthermore, a terminal, which is an external device, for measuring (monitoring) an output frequency (an inspection frequency) of the ring oscillator 103 may be provided as illustrated in FIG. 2. The result of the measurement obtained by the external device is supplied to the first controller 104, and the first controller 104 need just perform a control process on the reference voltage generating circuit 101 out of the above-mentioned operations. In this case, a frequency demultiplier (not illustrated) for reducing the output frequency of the ring oscillator 103 to a frequency that can be measured by the external device may be further connected.

Operation of Power Supply Voltage Regulating Apparatus

Next, a method for regulating the power supply voltage in the power supply voltage regulating apparatus 100 is described in detail.

Figure 7:
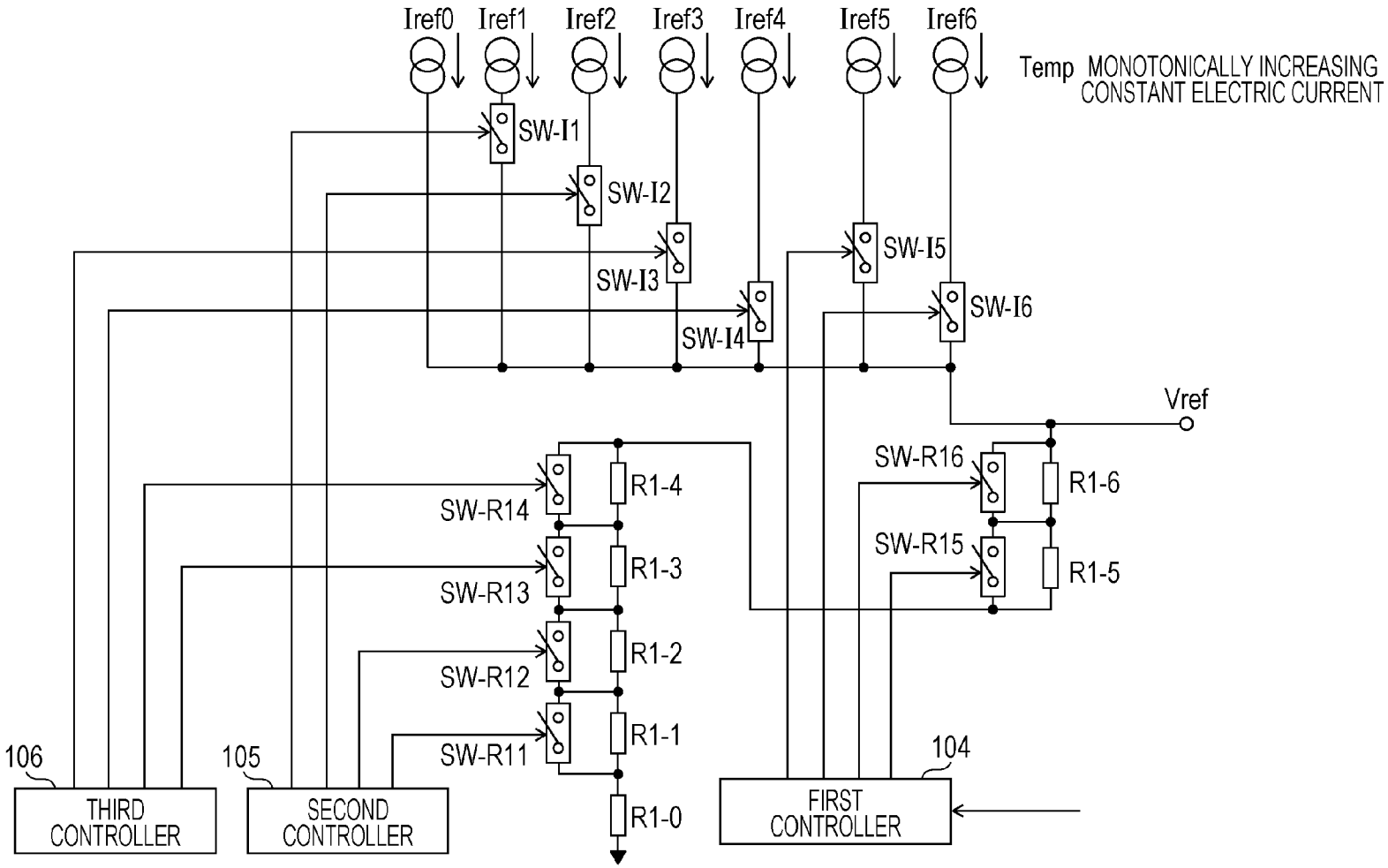
FIG. 7 is a view illustrating a process of controlling a reference voltage according to Embodiment 1 of the present disclosure.

FIG. 7 is a view illustrating constituent elements that are involved in control of the reference voltage Vref in the power supply voltage regulating apparatus 100.

The value of the variable constant electric current circuit Iref in FIG. 2 is determined by a combination of constant electric current circuits Iref0 to Iref6 illustrated in FIG. 7. The constant electric current circuits Iref0 to Iref6 are switched on and off by switches SW-I1 to SW-I6, respectively. More specifically, the constant electric current circuits Iref1 and Iref2 are switched on and off by the switches SW-I1 and SW-I2 controlled by the second controller 105, the constant electric current circuits Iref3 and Iref4 are switched on and off by the switches SW-I3 and SW-I4 controlled by the third controller 106, and the constant electric current circuits Iref5 and Iref6 are switched on and off by the switches SW-I5 and SW-I6 controlled by the first controller 104.

The value of the variable resistor R1 illustrated in FIG. 2 is determined by a combination of serially connected resistors R1-0 to R1-6 illustrated in FIG. 7. The resistors R1-1 to R1-6 are switched on and off by switches SW-R11 to SW-R16, respectively. More specifically, the resistors R1-1 and R1-2 are switched on and off by the switches SW-R11 and SW-R12 controlled by the second controller 105, the resistors R1-3 and R1-4 are switched on and off by the switches SW-R13 and SW-R14 controlled by the third controller 106, and the resistors R1-5 and R1-6 are switched on and off by the switches SW-R15 and SW-R16 controlled by the first controller 104.

Note that a diode may be serially connected to the resistor R1-0. Note also that the number of constant electric current circuits constituting the variable constant electric current circuit Iref and the number of resistors constituting the variable resistor R1 in the reference voltage generating circuit 101 are not limited to those in the example of the configuration illustrated in FIG. 7, provided that the number of constant electric current circuits and the number of resistors are 2 or more.

First, a method for controlling the reference voltage Vref in accordance with the oscillating frequency of the ring oscillator 103 is described.

One of values representing characteristics of an MOS transistor is a threshold value that indicates a voltage at which a drain electric current rapidly flows out (also referred to as a threshold voltage). This threshold value can vary from one element to another due to a production variation. Accordingly, a minimum electric current needed for operation of the switching circuit 1 varies depending on the MOS transistor constituting the switching circuit 1 due to the variation of the threshold value.

Furthermore, an MOS transistor has such a characteristic that an output frequency becomes higher as a threshold value becomes lower. It is assumed here that an MOS transistor having a size (configuration) identical to the MOS transistor constituting the switching circuit 1 is used in the ring oscillator 103 as described above. In this case, it is considered that the output frequency of the MOS transistor of the ring oscillator 103 and the output frequency of the MOS transistor of the switching circuit 1 have the same characteristics.

In view of this, in the present embodiment, the first controller 104 measures (monitors) the output frequency of the ring oscillator 103 and controls the reference voltage Vref in accordance with the measured output frequency. That is, the first controller 104 controls the reference voltage Vref taking the element variation of the switching circuit 1 into consideration by using the oscillating frequency of the ring oscillator 103 instead of the switching circuit 1. For example, the control operation of the reference voltage Vref by the first controller 104 may be performed at an inspection step or at power activation of an electronic apparatus including the power supply voltage regulating apparatus 100. Furthermore, for example, the first controller 104 may include an E-fuse for setting the reference voltage Vref.

Specifically, the first controller 104 controls the variable constant electric current circuit Iref or the variable resistor R1 so that the reference voltage Vref becomes lower as the oscillating frequency of the ring oscillator 103 becomes higher. For example, in FIG. 6, the first controller 104 controls the reference voltage Vref by switching the switches SW-I5 (the constant electric current circuit Iref5), SW-I6 (the constant electric current circuit Iref6), SW-RI5 (the resistor R1-5), and SW-RI6 (the resistor R1-6) in accordance with the result of the measurement of the frequency. In this way, the first controller 104 sets the power supply voltage lower by setting the reference voltage Vref lower as the oscillating frequency of the ring oscillator 103 becomes higher.

Next, a method for controlling the reference voltage Vref in accordance with the temperature characteristics of the switching circuit 1 is described.

As described above, it is assumed that the variable constant electric current circuit Iref illustrated in FIG. 1 includes a constant electric current circuit which causes the variable constant electric current Iref to monotonically increase in accordance with temperature. The gradient of the monotonic increase corresponds to the temperature characteristics of the switching circuit 1. That is, the variable constant electric current Iref becomes larger as the temperature of the switching circuit 1 becomes higher.

Furthermore, the second controller 105 controls the variable constant electric current circuit Iref or the variable resistor R1 so that the reference voltage Vref becomes higher as the temperature of the switching circuit 1 becomes higher. For example, in FIG. 6, the second controller 105 controls the reference voltage Vref by switching the switches SW-I1 (the constant electric current circuit Iref1), SW-I2 (the constant electric current circuit Iref2), SW-R11 (the resistor R1-1), and SW-R12 (the resistor R1-2) in accordance with the temperature characteristics of the switching circuit 1. In this way, the second controller 105 sets the power supply voltage higher by setting the reference voltage Vref higher as the temperature of the switching circuit 1 becomes higher.

For example, the second controller 105 includes a temperature sensor circuit that measures the temperature characteristics of the switching circuit 1 and a control circuit that controls the reference voltage Vref.

In this way, the reference voltage generating circuit 101 generates a reference voltage Vref suitable for the temperature characteristics of the switching circuit 1 (MOS transistor) under control according to the temperature characteristics by the second controller 105 in addition to the constant electric current circuit Iref that is caused to monotonically increase in accordance with the temperature by a constant electric current circuit.

Figure 8:
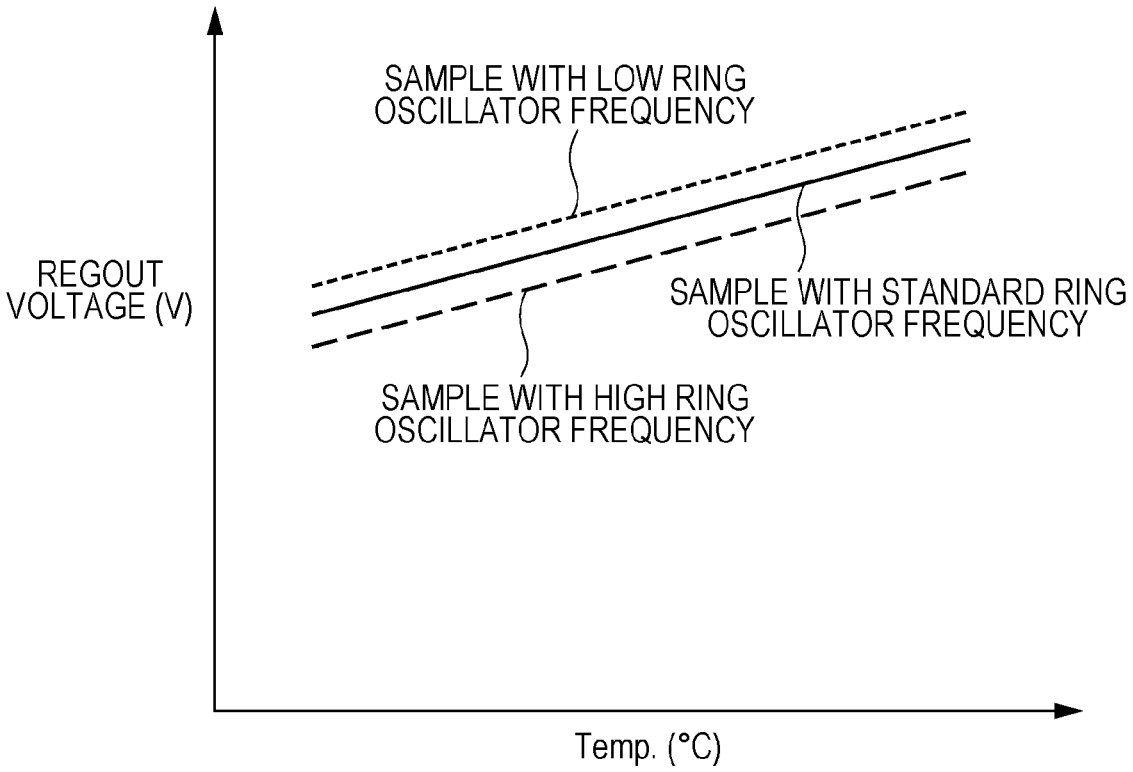
FIG. 8 is a view illustrating temperature characteristics of a power supply voltage according to Embodiment 1 of the present disclosure.

In the power supply voltage regulating apparatus 100, the power supply voltage is thus set higher as the temperature of the switching circuit 1 becomes higher. FIG. 7 illustrates the temperature characteristics of the power supply voltage (REGOUT). As illustrated in FIG. 8, the power supply voltage becomes higher (monotonically increases) as the temperature becomes higher. As described above, the power supply voltage varies depending on the output frequency of the ring oscillator 103 as illustrated in FIG. 8.

The frequency characteristics of an MOS transistor deteriorate (operating speed of an MOS transistor slows down) as the temperature increases. By setting the power supply voltage higher as the temperature of the switching circuit 1 increases as in the present embodiment, it is possible to suppress a deterioration in frequency characteristics in the switching circuit 1 caused by an increase in temperature.

The second controller 105 may cause the gradient of the fluctuation (monotonic increase) of the variable constant electric current Iref with respect to temperature to be variable in accordance with the temperature characteristics of the switching circuit 1. For example, the second controller 105 may cause a gradient indicative of the degree of increase of electric current with temperature to vary among the variable constant electric current circuits Iref0 to Iref6 illustrated in FIG. 6.

Finally, a method for controlling the reference voltage Vref in accordance with the operating frequency of the switching circuit 1 is described.

The third controller 106 controls the reference voltage Vref by switching the switches SW-I3 (the constant electric current circuit Iref3), SW-I4 (the constant electric current circuit Iref4), SW-R13 (the resistor R1-3), and SW-R14 (the resistor R1-4) illustrated in FIG. 6 in accordance with the operating frequency of the switching circuit 1. That is, the third controller 106 sets the power supply voltage by setting the reference voltage Vref in accordance with the operating frequency of the switching circuit 1.

The operating frequency of the switching circuit 1 is grasped in advance. Therefore, the third controller 106 sets the reference voltage Vref by outputting a control signal corresponding to the operating frequency of the switching circuit 1, for example, by using a frequency setting register which is a logic circuit.

FIG. 8 illustrates characteristics of a power supply voltage with respect to the operating frequency in a case where the switching circuit 1 is a circuit other than a VCO circuit. As illustrated in FIG. 8, as the operating frequency of the switching circuit 1 becomes higher, the power supply voltage becomes higher. As in FIG. 7, the power supply voltage varies depending on the output frequency of the ring oscillator 103 as illustrated in FIG. 8.

That is, the third controller 106 sets the power supply voltage higher by setting the reference voltage Vref higher as the operating frequency of the switching circuit 1 becomes higher in a case where the switching circuit 1 is a circuit other than a VCO circuit.

Figure 9:
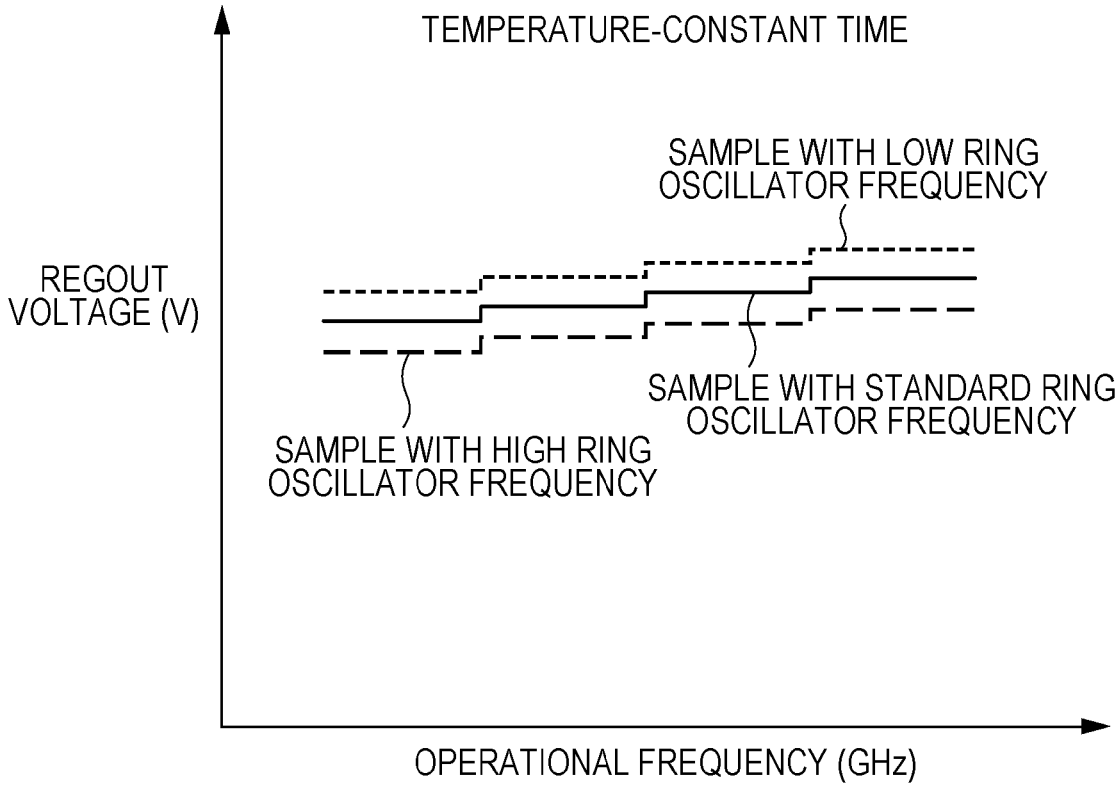
FIG. 9 is a view illustrating a relationship between an operating frequency of a switching circuit (circuit other than a VOC circuit) and a power supply voltage according to Embodiment 1 of the present disclosure.
Figure 10:
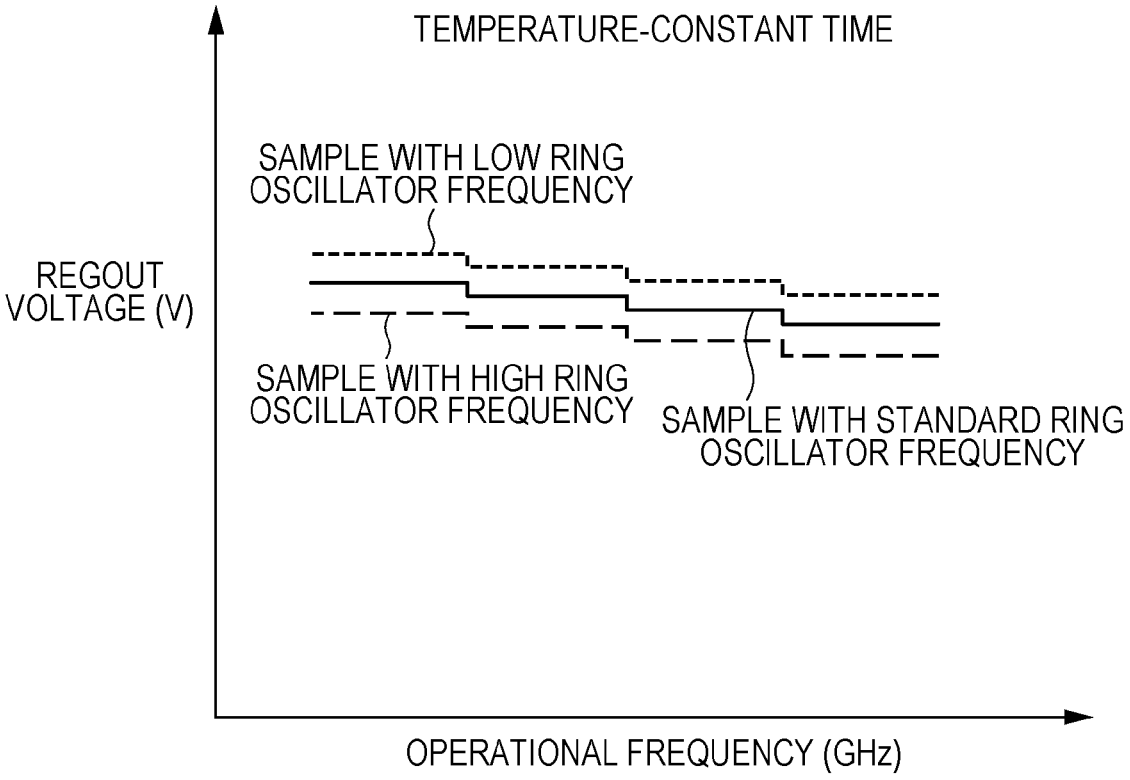
FIG. 10 is a view illustrating a relationship between an operating frequency of a switching circuit (a VOC circuit) and a power supply voltage according to Embodiment 1 of the present disclosure.

Meanwhile, FIG. 9 illustrates characteristics of the power supply voltage with respect to the operating frequency in a case where the switching circuit 1 is a VCO circuit (see FIG. 4). As illustrated in FIG. 9, as the operating frequency of the switching circuit 1 becomes higher, the power supply voltage becomes lower. As in FIG. 7, the power supply voltage varies depending on the output frequency of the ring oscillator 103 as illustrated in FIG. 9.

That is, the third controller 106 sets the power supply voltage lower by setting the reference voltage Vref lower as the operating frequency of the switching circuit 1 becomes higher in a case where the switching circuit 1 is a VCO circuit.

The reason why the power supply voltage becomes lower as the operating frequency becomes higher in a VCO circuit is as follows. As illustrated in FIG. 4, in the VCO circuit, a variable capacitor (C) is used as means for causing the oscillating frequency to be variable, and the oscillating frequency is increased by reducing the variable capacitor. It is therefore possible to suppress a drain electric current flowing through the PchMOS transistors and the NchMOS transistors illustrated in FIG. 4 that is a gm value of a resonator necessary for driving this variable resistor.

As described above, the power supply voltage regulating apparatus 100 illustrated in FIG. 2 controls the reference voltage Vref on the basis of a variation state such as a production variation of the element (e.g. MOS transistor) of the switching circuit 1 by using the oscillating frequency of the ring oscillator 103. Furthermore, the power supply voltage regulating apparatus 100 controls the reference voltage Vref on the basis of the temperature characteristics and the operating frequency of the switching circuit 1, that is, an environmental state in which the switching circuit 1 operates.

In this way, the power supply voltage regulating apparatus 100 can supply a power supply voltage optimum for operation of the switching circuit 1 by generating a reference voltage in accordance with the state and the operation environment of the switching circuit 1. That is, the power supply voltage regulating apparatus 100 can supply a minimum power supply voltage needed for operation of the switching circuit 1. It is therefore possible to reduce power consumption.

Furthermore, the power supply voltage regulating apparatus 100 regulates the power supply voltage by controlling the reference voltage Vref. Moreover, the power supply voltage regulating apparatus 100 controls the reference voltage Vref by specifying the variation state of the elements of the switching circuit 1 by using the ring oscillator 103 constituted by an MOS transistor that has a configuration substantially identical to the switching circuit 1. That is, in the power supply voltage regulating apparatus 100, there is no need to connect a variable resistor to the switching circuit 1 unlike a conventional art.

That is, in the present embodiment, the switching circuit 1 is directly connected to the output terminal (REGOUT) of the LDO 102 and GND as illustrated in FIG. 2. In other words, a resistor for electric current control, which is used in a conventional art, is not connected to the switching circuit 1.

Therefore, in the present embodiment, since a voltage fluctuation caused by a switching electric current of the switching circuit 1 does not occur on the power supply side and the GND side, it is possible to avoid a deterioration of phase noise characteristics of a switching signal. That is, according to the present embodiment, it is possible to secure good phase noise (jitter) characteristics.

Therefore, according to the present embodiment, it is possible to achieve a reduction in power consumption of a switching circuit while suppressing occurrence of phase noise.

Embodiment 2

Figure 11:
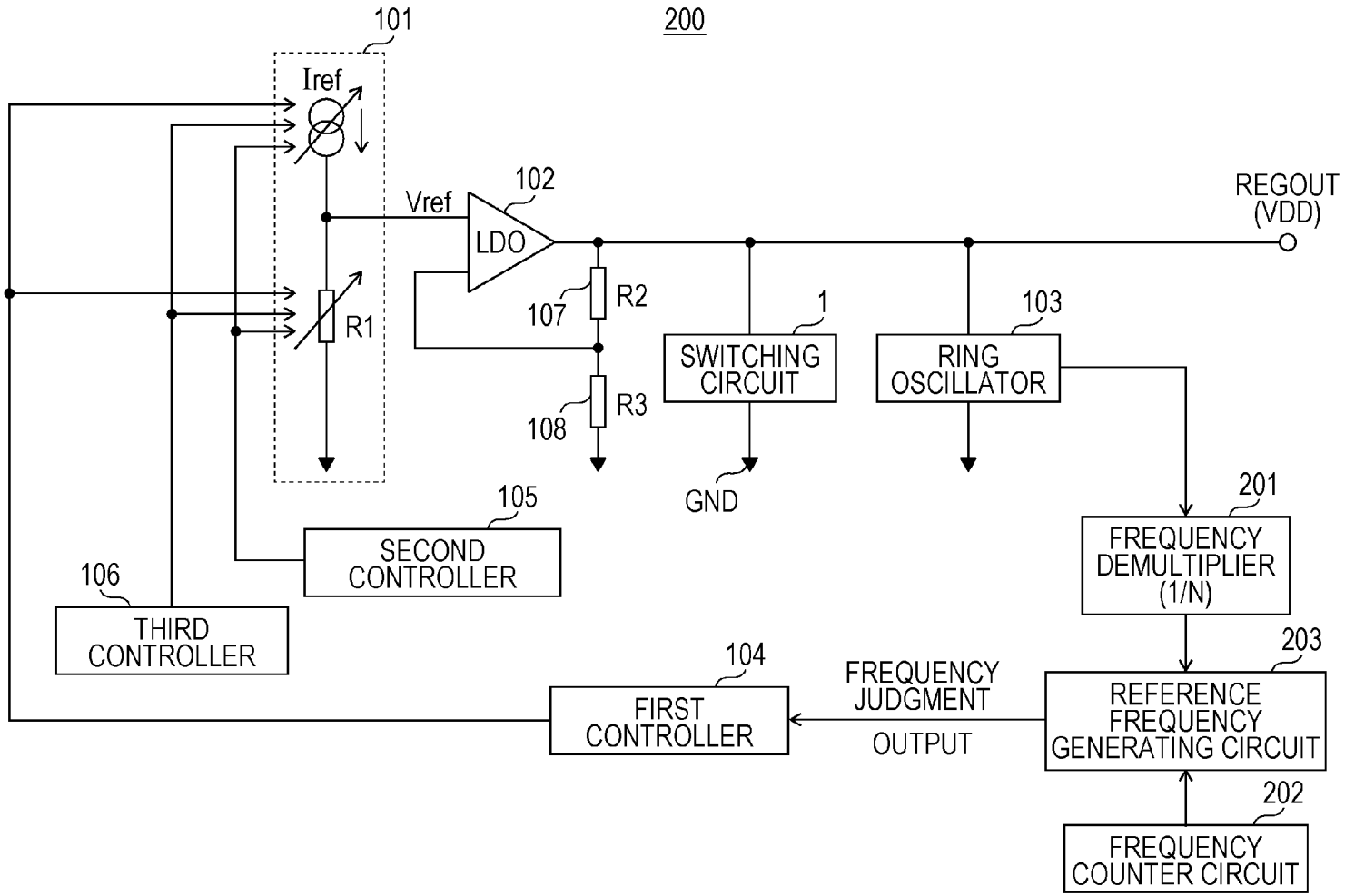
FIG. 11 is a view illustrating a configuration of a power supply voltage regulating apparatus according to Embodiment 2 of the present disclosure.

FIG. 11 illustrates a configuration of a power supply voltage regulating apparatus according to the present embodiment. In FIG. 11, constituent elements that are similar to those of FIG. 2 are given identical reference numerals and are not explained repeatedly.

As illustrated in FIG. 11, a power supply voltage regulating apparatus 200 according to the present embodiment includes a frequency demultiplier 201, a reference frequency generating circuit 202, and a frequency counter circuit 203 in addition to a configuration similar to that of FIG. 2.

The frequency demultiplier 201 divides oscillation signal output (high frequency) of the ring oscillator 103 by N (N is any positive integer) so as to obtain a signal of low frequency.

The reference frequency generating circuit 202 is, for example, a crystal oscillator and generates a reference signal having a frequency that serves as a reference for operation in the frequency counter circuit 203 (a reference frequency). Note that, for example, a crystal oscillator used in an apparatus other than the power supply voltage regulating apparatus 200 may be used also as the reference frequency generating circuit 202.

The frequency counter circuit 203 counts an output frequency of the frequency demultiplier 201 during a predetermined period on the basis of the reference signal (reference frequency). The frequency counter circuit 203 is a logic circuit. That is, the frequency counter circuit 203 specifies the oscillating frequency of the ring oscillator 103 by counting the frequency through comparison between the output signal of the frequency demultiplier 201 and the reference signal.

Then, the first controller 104 sets the reference voltage Vref on the basis of the oscillating frequency of the ring oscillator 103 specified by the frequency counter circuit 203.

In this way, in the present embodiment, the power supply voltage regulating apparatus 200 measures the output frequency of the ring oscillator 103 by using the frequency demultiplier 201 and the frequency counter circuit 203. This makes it possible to makes this monitoring process simpler than that in a case where the frequency is monitored by using an output of a high frequency.

The embodiments of the present disclosure have been described so far.

It is possible to apply the power supply voltage regulating apparatus 100 according to the above embodiments to any electronic apparatus using a power supply voltage.

The blocks used for the description of the embodiments are typically realized as an IC, which is an integrated circuit. These may be individually chipped or part or all of the functional blocks may be collectively chipped. Here, the term "IC" is used, but terms "LSI", "system LSI", "super LSI", and "ultra LSI" may be used depending on the degree of integration.

Furthermore, a method for realizing the integrated circuit is not limited to IC, but the integrated circuit may be realized by a dedicated circuit. An FPGA (Field Programmable Gate Array) that can be programmed after production of an LSI or a reconfigurable processor in which connection and settings of a circuit cell in the LSI can be reconfigured may be used.

Furthermore, if other techniques for achieving an integrated circuit that take the place of LSI appear as a result of the progress or derivation of the semiconductor technique, it is of course possible to realize integration of functional blocks by using such other techniques. One possibility is application of a biotechnology etc.

The present disclosure is applicable to an electronic apparatus including a switching circuit.

What is claimed is:

1. A power supply voltage regulating apparatus comprising:

a reference voltage generating circuit that generates a reference voltage;

an operational amplifier that amplifies the reference voltage and outputs the amplified reference voltage as a power supply voltage;

a switching circuit that is connected between an output terminal of the operational amplifier and ground, and that performs a switching operation;

a ring oscillator that is connected in parallel with the switching circuit between the output terminal of the operational amplifier and the ground, and that generates an oscillation signal; and a controller that is connected with an input terminal of the reference voltage generating circuit, and that controls the reference voltage in accordance with an oscillating frequency of the oscillation signal, a temperature of the switching circuit, and an operating frequency of the switching circuit, to regulate the power supply voltage that is output from the operational amplifier.

2. The power supply voltage regulating apparatus according to claim 1, wherein the controller controls the reference voltage by having a value of a variable constant electric current or a value of a variable resistor in the reference voltage generating circuit to be set in accordance with the oscillating frequency of the oscillating signal, the temperature of the switching circuit, and the operating frequency of the switching circuit, and regulates the power supply voltage to become higher as the reference voltage becomes higher.

3. The power supply voltage regulating apparatus according to claim 2, wherein the controller controls the reference voltage to become lower as the oscillating frequency becomes higher.

4. The power supply voltage regulating apparatus according to claim 1, wherein the ring oscillator is constituted by a metal oxide semiconductor transistor having a configuration identical to a metal oxide semiconductor transistor that constitutes the switching circuit.

5. The power supply voltage regulating apparatus according to claim 3, further comprising:

a frequency demultiplier that divides the oscillation signal that is output from the ring oscillator by N which is a positive integer; and a frequency counting circuit that specifies the oscillating frequency of the oscillating signal by counting a frequency of the output signal of the frequency demultiplier through comparison between the output signal of the frequency demultiplier and a reference signal, wherein the controller includes a first controller that controls the reference voltage on the basis of the oscillating frequency specified by the frequency counter circuit.

6. The power supply voltage regulating apparatus according to claim 1, wherein the switching circuit is directly connected to the output terminal of the operational amplifier and the ground.

7. The power supply voltage regulating apparatus according to claim 1, wherein the controller controls the power supply voltage to become higher as the temperature of the switching circuit becomes higher.

8. The power supply voltage regulating apparatus according to claim 2, wherein:

the value of the variable constant electric current in the reference voltage generating circuit is set to become higher as the temperature of the switching circuit becomes higher; and the controller controls the reference voltage to become higher as the temperature of the switching circuit becomes higher.

9. The power supply voltage regulating apparatus according to claim 8, wherein the controller sets a gradient of a fluctuation of the value of the variable constant electric current with respect to the temperature of the switching circuit, where the gradient is variable in accordance with temperature characteristics of the switching circuit.

10. The power supply voltage regulating apparatus according to claim 7, wherein the controller includes a second controller comprising a temperature sensor circuit that detects the temperature of the switching circuit and a control circuit that controls the reference voltage in accordance with the detected temperature.

11. The power supply voltage regulating apparatus according to claim 1, wherein the controller includes a third controller that controls the reference voltage in accordance with the operating frequency of the switching circuit.

12. The power supply voltage regulating apparatus according to claim 11, wherein the controller controls the reference voltage by using a register circuit which is a logic circuit.

13. The power supply voltage regulating apparatus according to claim 11, wherein:

the switching circuit is any one of an inverter multi-stage connection circuit, a crystal-oscillator circuit, a flip-flop circuit, and a NAND circuit; and the controller controls the reference voltage to become higher as the operating frequency of the switching circuit becomes higher.

14. The power supply voltage regulating apparatus according to claim 11, wherein:

the switching circuit is a voltage controlled oscillator circuit; and the controller controls the reference voltage to become lower as the operating frequency of the switching circuit becomes higher.

15. An integrated circuit comprising the power supply voltage regulating apparatus according to claim 1.

16. An electronic apparatus comprising the power supply voltage regulating apparatus according to claim 1.

* * * * *